US006202511B1

(12) United States Patent
Murray et al.

(10) Patent No.: US 6,202,511 B1
(45) Date of Patent: Mar. 20, 2001

(54) VIBRATION DAMPED HAMMER

(75) Inventors: John C. Murray, Collinsville, CT (US); David B. Scott, Sheffield (GB)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/371,586

(22) Filed: Aug. 10, 1999

Related U.S. Application Data

(60) Provisional application No. 60/096,688, filed on Aug. 14, 1998.

(51) Int. Cl.[7] ..... B25D 1/00
(52) U.S. Cl. ..... 81/22; 81/20
(58) Field of Search ..... 81/22, 20

(56) References Cited

U.S. PATENT DOCUMENTS

| | | | | |
|---|---|---|---|---|
| 1,311,820 | | 7/1919 | Jones . | |
| 1,707,787 | * | 4/1929 | Estwing | 81/22 |
| 2,850,331 | | 9/1958 | Curry et al. . | |
| 3,078,969 | | 2/1963 | Campbell et al. . | |
| 3,283,464 | | 11/1966 | Litzka . | |
| 3,320,985 | * | 5/1967 | Macguire et al. | 81/22 |
| 3,792,725 | | 2/1974 | Burgeson . | |
| 4,404,708 | | 9/1983 | Winter | 16/110 R |
| 4,425,980 | | 1/1984 | Miles | 181/208 |
| 4,633,741 | * | 1/1987 | Yang | 81/20 |
| 4,683,784 | * | 8/1987 | Lamont | 81/22 |
| 4,697,481 | | 10/1987 | Maeda | 81/22 |
| 4,721,021 | | 1/1988 | Kusznir . | |
| 4,738,166 | * | 4/1988 | Yamaguchi | 81/22 |
| 5,280,739 | * | 1/1994 | Liou | 81/22 |
| 5,308,675 | | 5/1994 | Crane et al. | 428/120 |
| 5,408,902 | | 4/1995 | Burnett | 81/22 |
| 5,588,343 | * | 12/1996 | Rust et al. | 81/489 |
| 5,657,674 | * | 8/1997 | Burnett | 81/22 |
| 5,896,788 | * | 4/1999 | Hreha et al. | 81/20 |
| 5,911,795 | * | 1/1999 | Tucker | 81/22 |

FOREIGN PATENT DOCUMENTS

| | | | | |
|---|---|---|---|---|
| 392555 | | 6/2000 | (CN) . | |
| 2135625 | | 9/1984 | (EP) . | |
| 74670 | * | 2/1949 | (NO) | 81/22 |

* cited by examiner

*Primary Examiner*—James G. Smith
*Assistant Examiner*—Hadi Shakeri
(74) *Attorney, Agent, or Firm*—Pillsbury Madison & Sutro LLP

(57) ABSTRACT

A hammer includes a rigid elongated support structure, a head carried at one end of the support structure, and a manually engageable gripping portion. An end of the elongated support structure includes a pair of vibration-receiving portions terminating in spaced apart relation with respect to each other and spaced from each other in a direction parallel to a swing plane of the hammer. The manually engageable gripping portion is formed from a resiliently deformable material molded around a portion of the support structure including the vibration-receiving portions so as to fill the space between the vibration-receiving portions. Vibration forces acting in a direction parallel to the swing plane of the hammer are generated by striking a striking surface of the head against an object. A portion of the vibration energy is transmitted through the support structure to the vibration-receiving portions, where the vibration energy is dampened and thereby dissipated by the resiliently deformable material surrounding the vibration-receiving portions. Accordingly, the level of vibration transmitted to the hand of the user is reduced.

15 Claims, 5 Drawing Sheets

VIBRATION DAMPED HAMMER

This application claims benefit to U.S. provisional 60/096,688 filed Aug. 14, 1998.

BACKGROUND OF THE INVENTION

The present invention relates to hammers and more particularly to hammers adapted to damp vibrations created during usage.

Conventional hammers typically include a steel or iron head fixedly secured to a rigid handle. Oftentimes the handle will be covered with a flexible sleeve to provide a gripping surface. When striking the head against an object, such as a nail or chisel, vibrations will be transmitted through the handle to the hand of the user. Over a period of usage, these vibrations can cause discomfort to the hand of the user and result in accelerated fatigue of the user's hand muscles. It is therefore desirable to provide a hammer which is particularly adapted to reduce the vibrations transmitted to the hand of the user.

SUMMARY OF THE INVENTION

It is therefore an object of the present invention to provide a hammer which overcomes the disadvantages mentioned above and suitably reduces the vibrations transmitted to the hand of the user.

In accordance with the principles of the present invention, there is provided a hammer comprising a rigid support structure extending longitudinally with respect to the hammer, a head provided on a first longitudinal end portion of the rigid support structure and arranged transversely with respect thereto, and a manually engageable gripping portion surrounding the rigid support structure and having an exterior surface constructed and arranged to be grasped by an individual using the hammer.

The head has a striking surface at one end thereof. The striking surface is arranged so that it strikes an object when the hammer is swung toward the object in its swing plane, thereby generating an impact force acting on the striking surface in a direction parallel to the swing plane. The impact force creates vibrations in the rigid support structure acting in a direction parallel to the swing plane.

The rigid support structure has a second end portion opposite the first longitudinal end portion. The second end portion comprises a pair of vibration-receiving portions extending longitudinally in a direction away from the first longitudinal end portion and terminating in spaced relation to one another. The vibration-receiving portions are spaced apart from one another in a direction parallel to the swing plane of the hammer.

The gripping portion is formed from resiliently deformable material, and a portion of the resiliently deformable material is received within the space between the vibration-receiving portions and surrounds the vibration-receiving portions. Accordingly, vibrations acting in a direction parallel to the swing plane received by the vibration-receiving portions are damped by the resiliently deformable material, to thereby reduce the level of vibration transmitted to the hand of the user.

Other objects, features, and characteristics of the present invention, as well as the methods of operation of the invention and the function and interrelation of the elements of structure, will become more apparent upon consideration of the following description and the appended claims with reference to the accompanying drawings, all of which form a part of this disclosure, wherein like reference numerals designate corresponding parts in the various figures.

DETAILED DESCRIPTION OF THE INVENTION

Figure 1:
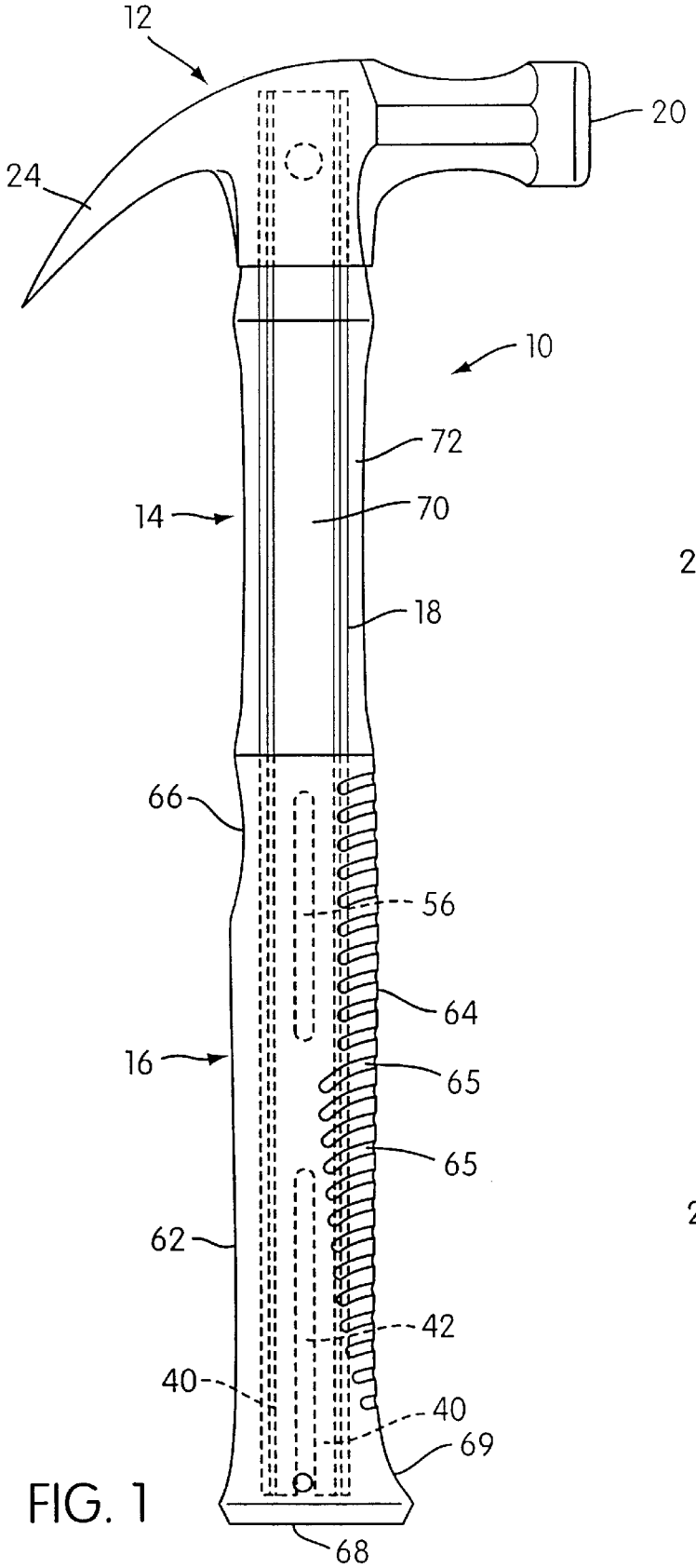
FIG. 1 is a profile view of a hammer constructed in accordance with the principles of the present invention.

Referring more particularly to the drawings, there is shown in FIG. 1 a hammer, generally indicated at 10, constructed in accordance with the principles of the present invention. The hammer 10 comprises a head, generally indicated at 12, a neck portion, generally indicated at 14, and a manually engageable gripping portion, generally indicated at 16. A rigid support structure 18 extends longitudinally with respect to the hammer 10.

Figure 2:
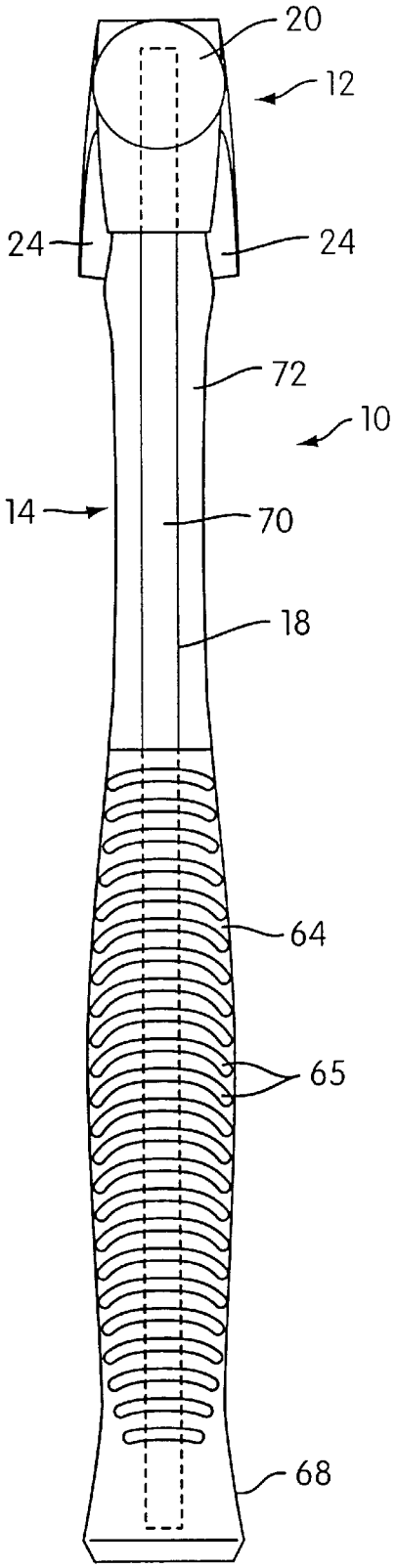
FIG. 2 is a front view of the hammer of FIG. 1.
Figure 3:
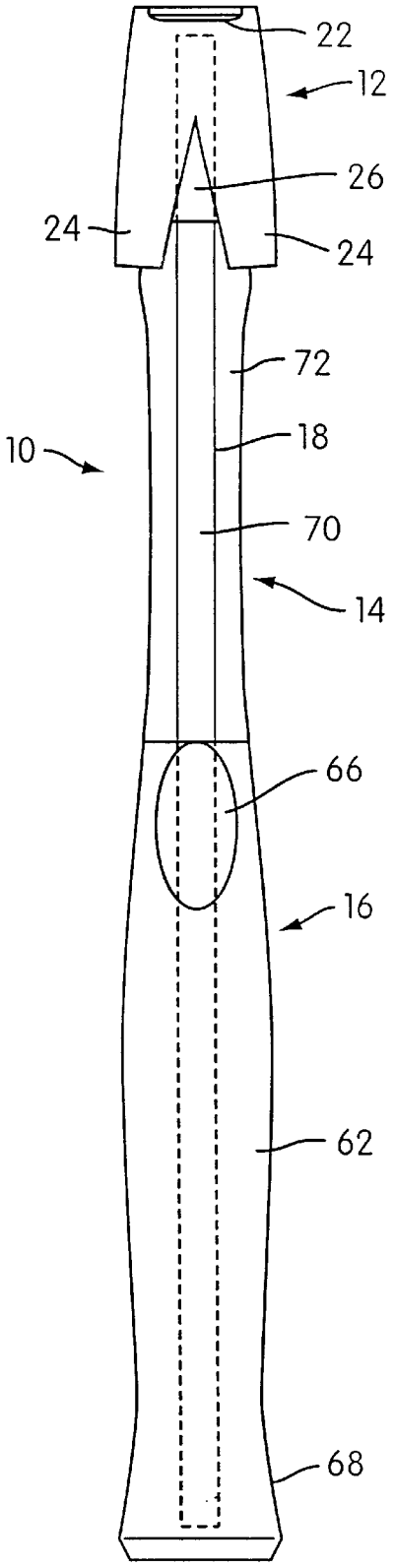
FIG. 3 is a rear view of the hammer of FIG. 1.

The head 12 includes a striking surface 20, an eye 22 (FIG. 4), and a pair of tapered, spaced-apart nail removing claws 24. When the hammer is swung in a swing plane of the hammer 10 (i.e., a plane, which, as viewed in FIGS. 2 and 3, is perpendicular to the page and extends longitudinally through the center of the hammer), the striking surface 20 strikes an object. That is, the striking surface 20 is transverse to the swing plane of the hammer 10. As is well known, the nail removing claws 24 are spaced apart so as to provide a V-shaped space 26 therebetween. The shank of a nail can be received in the V-shaped space 26 with the top of the hammer 10 facing the workpiece and the nail is removed by engaging the spaced apart claws 24 with the head of the nail and withdrawing it from the workpiece. The striking surface 20 is slightly convex in order to facilitate square contact during driving of nails.

Figure 8:
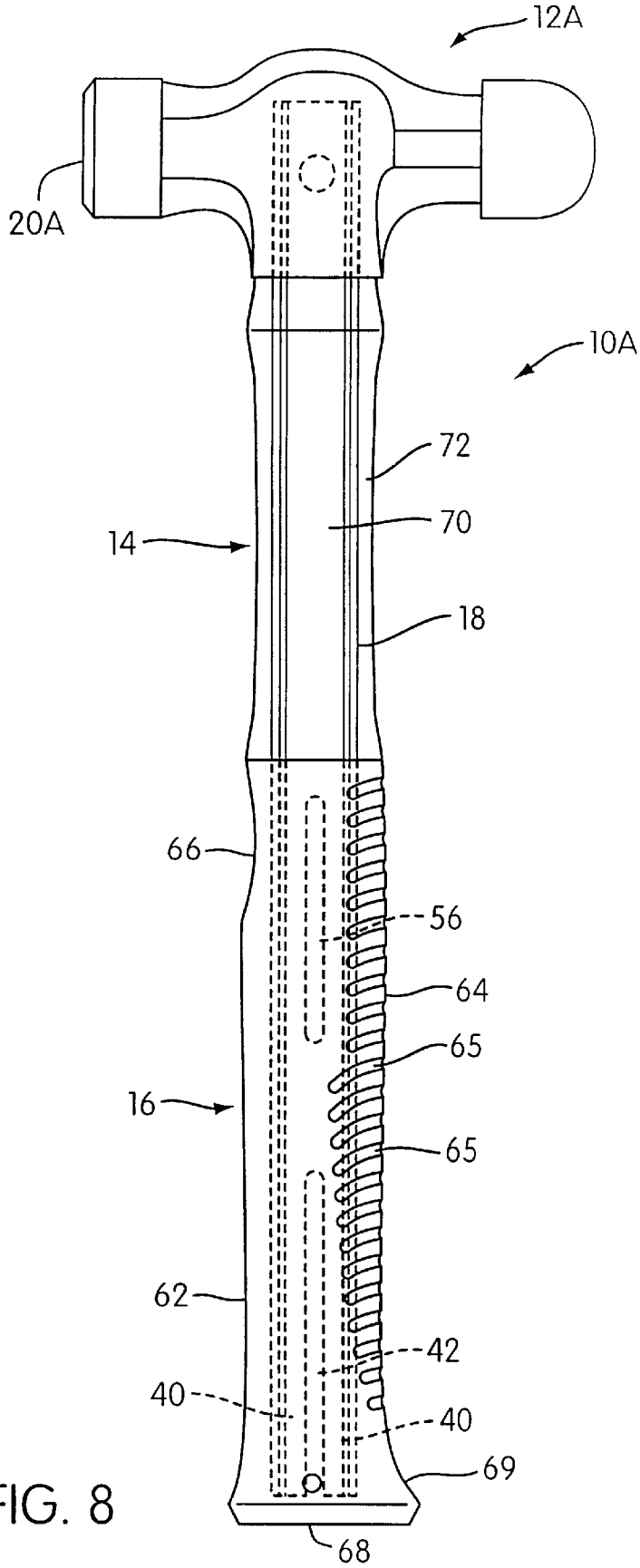
FIG. 8 illustrates a ballpeen hammer constructed in accordance with the principles of the present invention.

It can be appreciated that the hammer head 12 shown is of the conventional type but the principles of the present invention may be applied to other types of hammers such as ballpeen hammers and hand-held sledge hammers and mauls. FIG. 8 illustrates a ballpeen hammer 10A constructed in accordance with the principles of the present invention. Corresponding components between the conventional hammer 10 and the ballpeen hammer 10A are labeled with the same reference numerals. Instead of conventional head 12, the ballpeen hammer has a ballpeen head 12A with striking surface 20A.

The head 12 is provided on the top longitudinal end of the rigid support structure 18. When a user swings the hammer 12 in its swing plane and strikes the striking surface 20 of the head 12 against an object, such as a nail or chisel, an impact force acts on the on the striking surface 20 in a direction parallel to the swing plane. The impact force acting on the striking surface 20 generates a vibration in the rigid support structure 18 acting in a direction parallel to the swing plane of the hammer 10.

Figure 7:
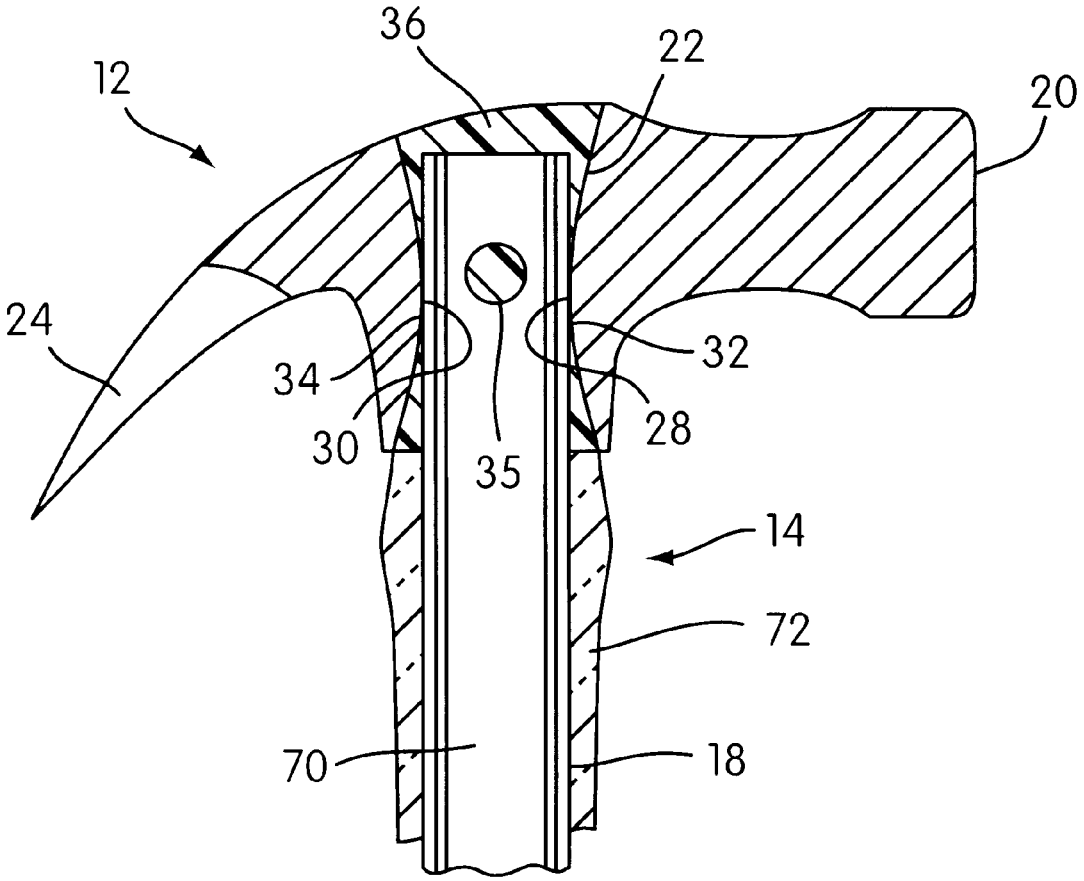
FIG. 7 is a cross-sectional view taken along lines 7—7 on FIG. 4.

In the illustrated embodiment, the head 12 is mounted on the top end of the rigid support structure 18 by inserting the top end of the rigid support structure 18 into the eye 22 of the head 12. It can be appreciated from FIG. 7 that the cross-sectional shape of the eye 22 is similar to that of an hourglass. The front and rear interior surfaces 28, 30 of the eye 22 have arcuate, convex configurations which provide the eye 22 with maximum diameters at the upper and lower ends thereof and a minimum diameter in the mid-region thereof. In the preferred embodiment of the invention, the minimum diameter of the eye 22 between the front and rear interior surfaces 28, 30 thereof is slightly less than the width of the rigid support structure 18 between the exterior front and rear surfaces 32, 34 thereof. The head 12 is mounted by forcing the rigid support structure 18 into the eye 22 such that the front and rear exterior surfaces 32, 34 of the rigid support structure 18 are forcibly engaged with the front and rear interior surfaces 28, 30 of the eye 22.

In order to further secure the rigid support structure 18 within the eye 22, a molten epoxy resin 36 is injected into the eye 22 so as to fill the interior of the eye 22 and form a solidified mass of epoxy 36 surrounding the top end of the rigid support structure 18. An epoxy-receiving opening 35 provided on the rigid support structure 18 is also filled with the solidified epoxy 36 and aids in securing the rigid support structure 18 within the eye 22.

Figure 4:
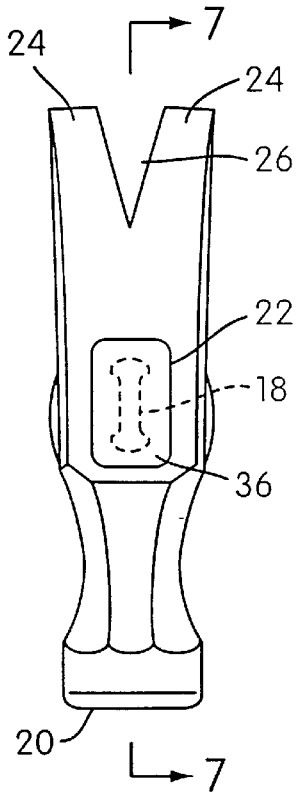
FIG. 4 is a top view of the hammer of FIG. 1.

It can be appreciated from the Figures that the illustrated rigid support structure 18 is an I-beam with the front and rear exterior surfaces 32, 34 being provided on the end caps 37 and the epoxy-receiving opening 35 being formed through the web 39 extending between the end caps 37. As shown in FIG. 4, the end caps of the rigid support structure 18 present convex arcuate exterior surfaces. It is contemplated that other configurations may be used, but the preferred configuration for the rigid support structure 18 is the illustrated I-beam. Preferably, both the head 12 and the rigid support structure 18 are made of steel. The solid connection between the head 12 and the rigid support structure 18 allows vibrations to be created in the rigid support structure 18 when a user strikes the striking surface 20 of the head 12 against an object. It is to be understood, however, that other methods of fastening the head 12 to the rigid support structure 18 may be utilized rather than the method of attachment shown. In fact, it is also possible to form the head 12 integral with the rigid support structure 18 as a one-piece construction within the scope of the present invention.

The rigid support structure 18 has vibration-receiving portions 40 at the bottom longitudinal end thereof opposite the head 12. The vibration-receiving portions 40 extend generally longitudinally to the bottom end of the rigid support structure 18 and are spaced apart from one another in a direction parallel to the swing plane so as to define a resiliently deformable material-receiving space 42 therebetween. The resiliently deformable material-receiving space 42 is open to the bottom longitudinal end of the rigid support structure 18. In the preferred embodiments of the present invention, the resiliently deformable material-receiving space 42 is formed through the web 39 of the I-beam constituting the rigid support structure 18.

Figure 5:
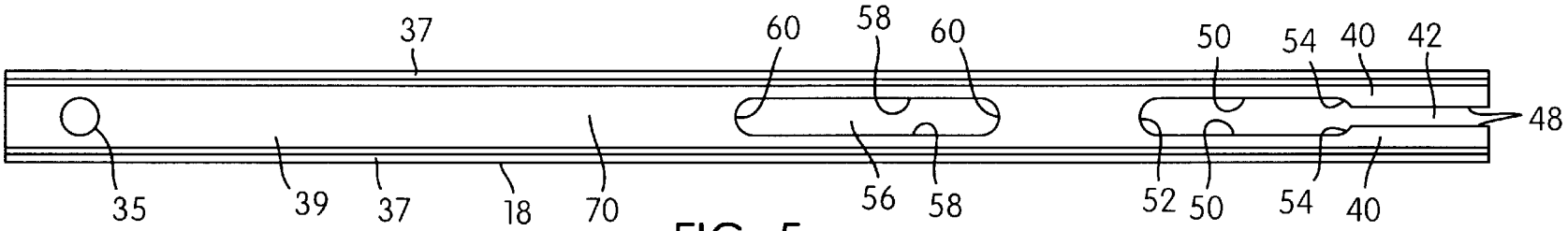
FIG. 5 is a side view of a rigid support structure utilized in the hammer of FIG. 1.
Figure 6:
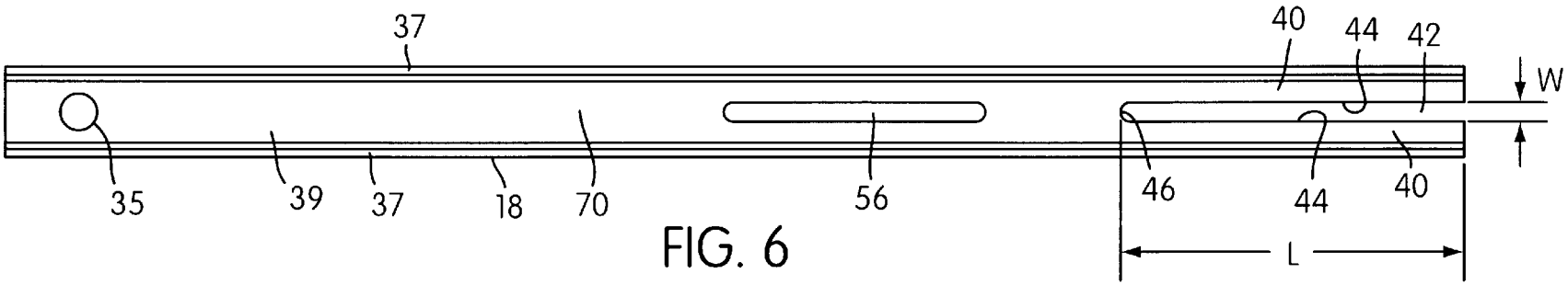
FIG. 6 is a side view of another rigid support structure utilized in the hammer of FIG. 1.

It can be appreciated from FIGS. 5 and 6 that the vibration-receiving portions 40 and the space 42 defined therebetween may take a variety of configurations. For example, the embodiment of FIG. 6 shows that the interior surfaces 44 of the vibration-receiving portions 40 which define the space 42 are substantially straight and terminate at an arcuate surface 46. This arrangement is preferred due to its simplicity and easy of manufacturing. FIG. 5 illustrates another example in which the vibration-receiving portions 40 have substantially straight interior surfaces 48 extending from the bottom longitudinal end and a widened portion defined by substantially straight interior surfaces 50 which are connected to one another by arcuate surface 52 and are connected to the substantially straight surfaces 48 by arcuate surfaces 54.

In addition, the rigid support structure 18 may be provided with a second resiliently deformable material-receiving space 56. The second material-receiving space 56 is spaced longitudinally from the space 42 towards the head 12 and defined by a pair of substantially straight interior surfaces 58 interconnected by arcuate surfaces 60. Although forming a second material-receiving space 56 is not essential to achieve the principles of the present invention, its provision is preferred for enhanced vibration damping.

Without regard to the specific configuration of the vibration-receiving portions 40 and the resiliently deformable material-receiving space 42 defined therebetween, the manually engageable gripping portion 16 surrounds the rigid support structure 18 and is formed from a solidified, resiliently deformable material. A portion of the resiliently deformable material is received within the resiliently deformable material-receiving space 42 and surrounds the vibration-receiving portions such that vibrations received by the vibration-receiving portions 40 are damped by the resiliently deformable material. Another portion of the resiliently deformable material is received within the second resiliently deformable material-receiving space 56. A portion of the vibrational energy that results when the striking surface 20 impacts a workpiece is transferred through the rigid support structure 18 to the vibration receiving portions 40, which together behave much like a tuning fork. The length L of each of the vibration-receiving portions 40 is greater than a width W of the space between the vibration-receiving portions 40. Vibration of the portions 40 is dampened because the resiliently deformable material is received within the resiliently deformable material-receiving space 42, thereby dissipating a significant portion of the vibrational energy transferred to the elements 50. Thus, the amount of vibration that is transmitted to the hand of the user following impact is reduced.

The preferred method of forming the manually engageable gripping portion 16 is to injection mold molten polyvinyl chloride (PVC) around the rigid support structure 18 so as to surround the rigid support structure 18, including the vibrations-receiving portions 40, and fill in the resiliently deformable material receiving spaces 42 and 56. The PVC material is then solidified.

Because the resiliently deformable material is received in space 56, the solidified grip is securely fastened to the rigid support structure 18. The intermediate portion 70 can also be provided with a plurality of additional holes therethrough to further enhance the securing of gripping portion 16 to the rigid support structure.

Preferably, the PVC contains 1 to 2% nylon in order to enhance the cosmetic appearance of the manually engageable portion 16 and has the following approximate physical properties:

| | |
|---|---|
| Tensile Strength | 540 P.S.I |
| Hardness (Shore A Durometer) | 71 +/− 5 |
| Specific Gravity | 1.49 |

The manually engageable gripping portion 16 is molded so as to provide a slightly concave surface 62 for the user to comfortably engage with the heel of his palm. Opposite the concave surface 62 is a textured convex surface 64 to be engaged by the user's fingers. The textured convex surface 64 includes a plurality of arcuate indentations 65 spaced longitudinally along the surface 64. Adjacent the concave surface 62 is a concave thumbrest surface 66.

As can be appreciated from FIGS. 2 and 3, the gripping portion 16 is wider in its mid-region and tapers inwardly towards the neck portion 14 and the butt-end portion 68. The butt-end portion 68 has an outwardly extending projection 69 which prevents the users hand from slipping off the end of the hammer 10 during usage.

The neck portion 14 is located between the manually engageable gripping portion 16 and the head 12. In the preferred embodiment of the present invention, the neck portion 14 includes an intermediate portion 70 of the rigid support structure 18 surrounded by rigid material 72. The preferred rigid material is an engineering-grade thermoplastic polyurethane used in extrusion and injection molding, such as Isoplast®. The rigid material 72 is injection molded around the intermediate portion 70 of the support structure 18 and when solidified provides a rigid, transparent covering for the intermediate portion 70. The actual appearance of the neck portion 14 is not essential to achieving the principles of the present invention, but the use of Isoplast® is preferred for cosmetic reasons. Furthermore, the use of such a structurally rigid material is desirable from a functional point of view because it protects the intermediate portion 70 of the rigid support structure 18 from being damaged during use of the hammer 10, whether such damage results from overstrikes or simply dropping the hammer 10.

It will thus be seen that the objects of the present invention have been fully and effectively accomplished. It will be realized, however, that the foregoing specific embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A hammer comprising:

a rigid support structure extending longitudinally with respect to s aid hammer;

a head provided on a first longitudinal end portion of said rigid support structure and arranged transversely with respect thereto, said head having a striking surface at one end thereof, said striking surface being arranged so that said striking surface strikes an object when said hammer is swung toward the object in a swing plane of the hammer thereby generating an impact force acting on said striking surface in a direction parallel to said swing plane, the impact force creating vibrations in said rigid support structure acting in a direction parallel to said swing plane, said rigid support structure having a second end portion opposite said first longitudinal end portion, said second end portion comprising a pair of vibration-receiving portions extending longitudinally in a direction away from said first longitudinal end portion and terminating in spaced relation to one another, said vibration-receiving portions being spaced apart from one another in a direction parallel to the swing plane of the hammer; and a manually engageable gripping portion surrounding said rigid support structure and having an exterior surface constructed and arranged to be grasped by an individual using the hammer, said gripping portion being formed from resiliently deformable material, a portion of said resiliently deformable material being received within the space between said vibration-receiving portions and surrounding said vibration-receiving portions, such that vibrations acting in a direction parallel to the swing plane received by said vibration-receiving portions are damped by said resiliently deformable material, to thereby reduce the level of vibration transmitted to the hand of the user, wherein a length of each of said vibration-receiving portions is greater than a width of the space between the vibrator-receiving portions.

2. The hammer of claim 1, wherein said head includes a pair of tapered, spaced-apart nail removing claws at an end of said head opposite said striking surface.

3. The hammer of claim 1, wherein said head comprises a ballpeen head.

4. The hammer of claim 1, wherein said first longitudinal end portion of said rigid support structure is inserted into an eye formed in said head, said eye comprising a bore formed through said head, said bore having first and second opposed interior surfaces, each having an arcuate convex configuration, so that, progressing from one end of said bore to an opposite end thereof, the interior surfaces of the bore first taper inwardly toward a section of minimum transverse dimension and then taper outwardly.

5. The hammer of claim 4, wherein the rigid support structure includes front and rear exterior surfaces, and wherein the transverse dimension at the section of minimum transverse dimension of said bore is slightly less than the transverse dimension of said rigid support structure, so that when said rigid support structure is forcible inserted into said eye, the front and rear exterior surfaces of said rigid support structure are forcibly engaged with portions of the first and second interior surfaces of said bore.

6. The hammer of claim 5, wherein said rigid support structure is secured within said eye by an epoxy resin injected into said eye so as to fill the interior of said bore.

7. The hammer of claim 1, wherein said rigid support structure comprises an I-beam having opposed end caps and an internal web extending between said end caps.

8. The hammer of claim 1, wherein said head and said rigid support structure are made from steel.

9. The hammer of claim 1, wherein said rigid support structure includes a second resiliently deformable material-receiving space, wherein a portion of said resiliently deformable material of said manually engageable gripping portion is received within said second resiliently deformable material-receiving space.

10. The hammer of claim 1, wherein said manually engageable gripping portion is formed from injection molded polyvinylchloride.

11. The hammer of claim 10, wherein said polyvinylchloride contains 1–2% nylon.

12. The hammer of claim 1, wherein said manually engageable gripping portion includes a plurality of arcuate indentations spaced longitudinally along an exterior surface of one side thereof, and a concave thumbrest surface formed on an exterior surface of an opposite side thereof.

13. The hammer of claim 1, wherein an intermediate portion of said rigid support structure between said head and said manually engageable gripping portion is surrounded by a rigid material comprising thermoplastic polyurethane.

14. The hammer of claim 1, wherein the space between said vibration-receiving portions is substantially constant at least along a portion of the longitudinal portion of the rigid support structure.

15. The hammer of claim 1, wherein the vibration-receiving portions include inside surfaces that are parallel to one another along at least one portion of the vibration-receiving portions.

* * * * *